US005227750A

United States Patent [19]

Connell et al.

[11] Patent Number: 5,227,750

[45] Date of Patent: Jul. 13, 1993

[54] SOLENOID OPERATED SWITCHING DEVICE

[75] Inventors: Richard A. Connell, Cottenham; Alan Godfrey, Worlington; Brian Darlow, Bottisham, all of United Kingdom

[73] Assignee: PED Limited, Newmarket, United Kingdom

[21] Appl. No.: 839,402

[22] Filed: Feb. 20, 1992

[51] Int. Cl.[5] ..... H01H 51/22

[52] U.S. Cl. ..... 335/86; 335/78; 335/128

[58] Field of Search ..... 335/78-86, 335/128-132, 202

[56] References Cited

U.S. PATENT DOCUMENTS 4,258,344 3/1981 Nishimi ..... 335/129
4,831,348 5/1989 Agatahama et al. ..... 335/80
4,949,058 8/1990 Nishikawa et al. ..... 335/129

*Primary Examiner*—Lincoln Donovan
*Attorney, Agent, or Firm*—Lee, Mann, Smith, McWilliams, Sweeney & Ohlson

[57] ABSTRACT

A switching device (FIGS. 5 A and 5B) employs as actuator a bistable solenoid which includes a plunger (16) movable within a winding (12) between end positions in each of which it is held by permanent magnets (18, 20). The plunger (16) of the actuator is engageable with an insulated lever (86) which in turn actuates a contact blade (76) via a spring (108). The lever may be cranked, and may have an extension (90) outside of the casing (70) to enable the device to be manually operated or to provide a visual indication of the state of the switch. Other types of solenoid may be employed as the actuator.

18 Claims, 4 Drawing Sheets

SOLENOID OPERATED SWITCHING DEVICE

FIELD OF THE INVENTION

The present invention relates to solenoids, and more particularly to switching devices such as relays which incorporate solenoid actuators.

BACKGROUND OF THE INVENTION

It is known, for example from GB2154371 and GB2202378, to provide a contact breaker having a pivoted armature carrying a moveable contact and provided with a permanent magnet to latch the armature in positions corresponding to the open or closed contact positions of the contact breaker. This arrangement results in a device having insufficient electrical insulation between the low voltage drive windings and the high voltage contact breaker section.

It is an object of the present invention to provide an improved solenoid operated switching device without the foregoing disadvantage.

SUMMARY OF THE INVENTION

According to the present invention there is provided switching device comprising a solenoid actuator, a lever made of electrically insulating material pivotally mounted for movement by the actuator, a flexible switch contact bearing element having a movable contact at one end for engagement with a fixed contact, and connection means connecting the lever to the contact bearing element to move the contacts between open and closed states.

The contact bearing element may be in the form of a blade which is substantially parallel to the axis of the solenoid actuator, and the lever is cranked so that it has a first arm substantially aligned with the blade.

The switching device may further comprise an electrically insulating wall mounted between the solenoid actuator and the first arm of the lever.

Preferably the connection means comprises a compression spring acting between the first arm and the contact bearing element. In this case the resilient connection means may comprises a U-shaped member extending over the contact bearing element and engageable with the remote side thereof to open the movable contact.

A second spring may be disposed between a fixed part of the device and the U-shaped member to assist opening of the movable contact.

Preferably the device is mounted in a casing and the lever is formed with an extension outside of the casing to enable the device to manually operated. Advantageously the extension of the lever may then be separable from the lever which moves as the solenoid actuator is operated, the end of the lever being visible through a window in the casing whereby when the extension is removed there remains a means for indicating whether the switch is open or closed.

In a further advantageous arrangement the solenoid actuator is adjustably mounted, to enable the contact separation between the fixed and movable contacts to be readily adjusted.

The use of a non-conductive pivotted lever linked at one end to the solenoid plunger and at the other to one of the switching contacts provides a construction of actuator having the following advantages:

a) all components are assembled into a half-case and are readily accessible during manufacture and test, and subsequently for maintenance or fault-finding;

b) the casing may be constructed to give isolation well in excess of current requirements between the low voltage signal drive circuits powering the solenoid coil and the high voltage switching section; and c) adjustment of the contact separation is simply achieved in manufacture, or subsequently, by simple adjustment of the solenoid along its principle axis by loosening mounting screws which may pass through brackets slotted parallel to the solenoid axis. This movement is transmitted to the moving contact of the switch via the pivotted lever, linked at its other end to the solenoid plunger.

BRIEF DESCRIPTION OF DRAWINGS

Embodiments of the invention, given by way of example only, will now be described with reference to the accompanying drawings in which

FIG. 6 shows a deflection/force diagram for the device of FIGS. 5A and 5B;

FIG. 7 is a plan view of a modified switching device;

DETAILED EMBODIMENTS OF THE EMBODIMENT

Figure 1:
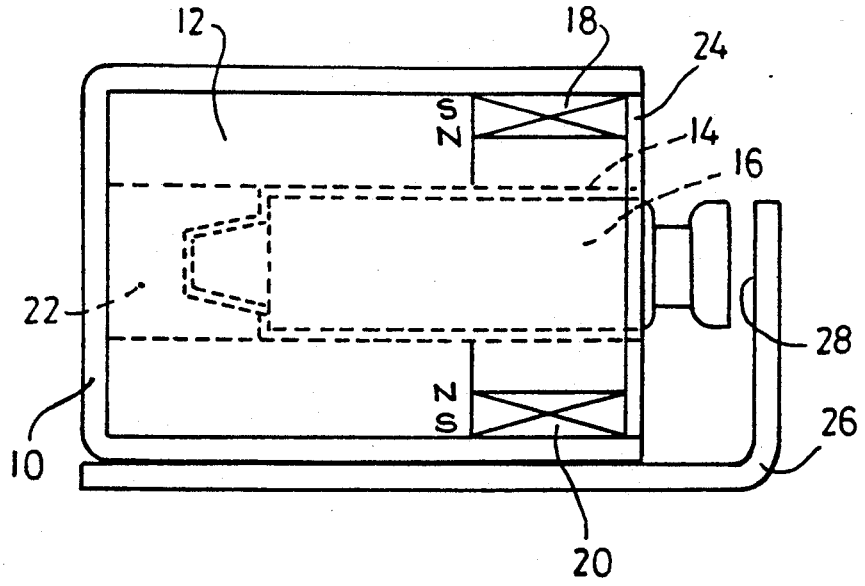
FIG. 1 is a plan view of a solenoid in accordance with the invention.

FIG. 1 shows a solenoid in accordance with the invention. A yoke 10 of magnetic steel mounts a winding 12 surrounding a plunger tube 14 of non-magnetic material such as brass, which contains as a sliding fit within it a plunger 16 also of magnetic steel. Also mounted about plunger tube 14 and aligned with winding 12 is an assembly containing two permanent magnets 18 and 20. The winding sits upon end-stop 22 mounted on yoke 10, and the winding and magnet assembly are held in position in yoke 10 by the non-magnetic closure plate 24 across the mouth of yoke 10 through which plunger 16 passes.

Attached to yoke 10 and extending forward of it into the region of the head of plunger 16 is an extension piece 26 or nose of magnetic steel forming part of the magnetic circuit of the solenoid.

Figure 2:
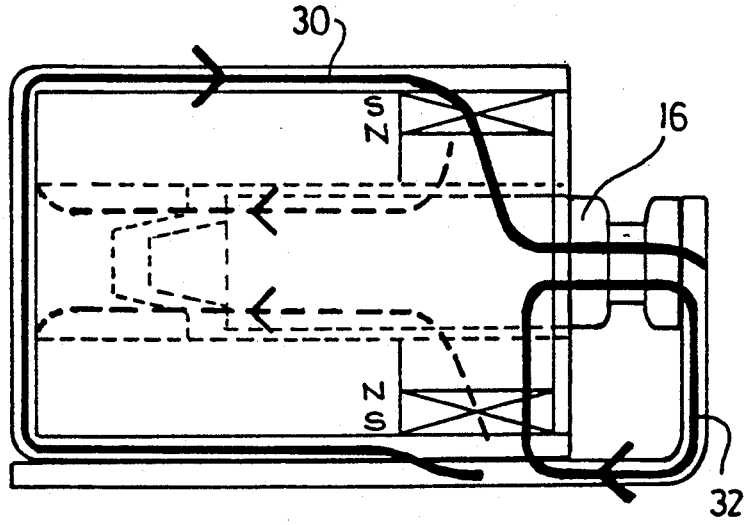
FIGS. 2 and 3 show the flux paths of the solenoid of FIG. 1, with the plunger respectively in extended and retracted positions.

FIG. 2 shows the solenoid of FIG. 1 with plunger 16 extended from the winding and magnet assembly and engaged with the inner end face 28 of extension piece 26 in one of the two stable states of the solenoid. In this outer position the magnetic flux from the permanent magnets 18 and 20 maintain the plunger 16 in engagement with end face 28. The principal flux paths in this state are shown by solid lines 30 and 32.

Figure 3:
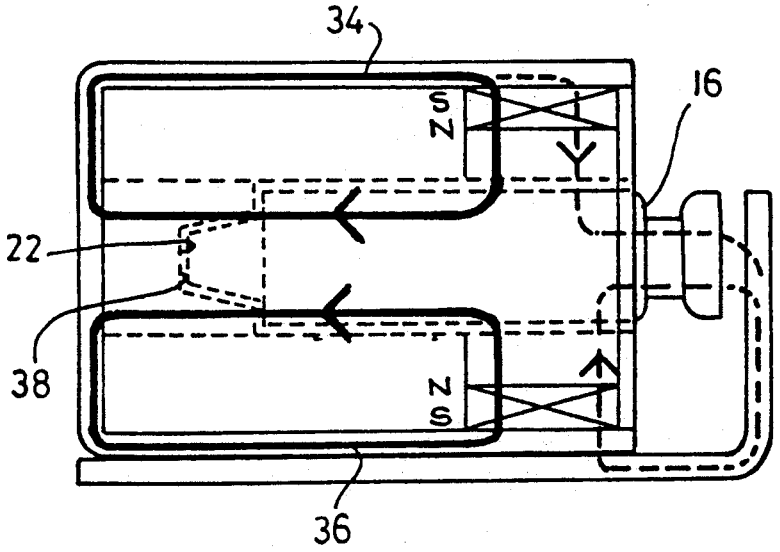

FIG. 3 shows the plunger 16 drawn into the solenoid and held in this position by the flux from permanent magnets 18 and 20. The principal flux paths are indicated by the solid lines 34 and 36. An air gap 38 is maintained between plunger 16 and end stop 22.

Translation of plunger 16 from one of its stable states to the other is by energisation of winding 12 by a current pulse of magnitude and polarity appropriate to produce an electromagnetic field in the magnetic circuit of the solenoid to counteract the field from the permanent magnets 18 and 20 and impart movement of the plunger 16 toward the other stable position. Winding 12 may either be single and fed with pulses of opposite polarities to effect movement in opposite directions, or alternatively may be double wound, enabling a pulse of the same polarity to be used to produce motion of the plunger in either direction when applied to the appropriate one of the two windings.

A solenoid of the construction described provides maximum drive and hold forces at the full extend of travel of the plunger 16 in each direction, and positive retention of plunger in the outer position shown in FIG. 2.

Figure 4A:
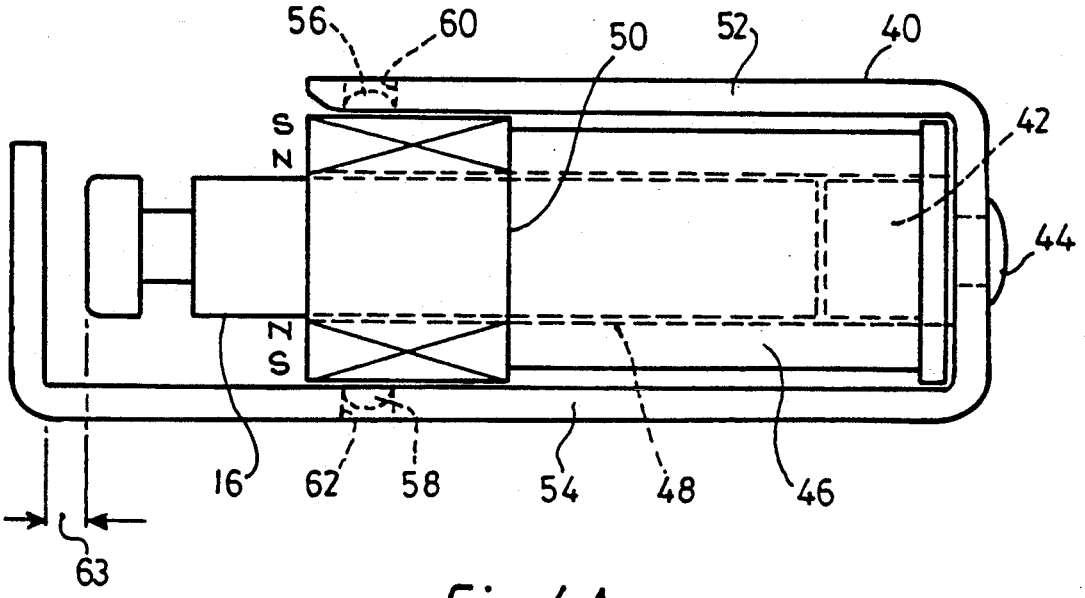
FIG. 4A is a plan view of a preferred form of constructions of a solenoid.

A preferred form of construction of a solenoid in accordance with the invention is shown in FIG. 4A in which the yoke and forward extension are formed as a single open-sided frame 40 providing a more efficient magnetic circuit, a reduction in the number of piece-parts and a simplification of manufacture.

Manufacture of a solenoid constructed as shown in FIG. 4A could be effected automatically or semi-automatically.

The steps of manufacture from piece-parts and sub-assemblies are:

1) rivetting a plunger end-stop 42 to frame 40 by a rivet 44;
2) inserting the internal assembly comprising winding 46, internal tube 48 containing the plunger 16, and permanent magnet assembly 50 into the frame 40 between its upper and lower limbs 52 and 54 in a direction transverse to the principle axis of the frame;
3) moving the internal assembly axially such that the right hand end of winding 46 then sits over end stop 42;
4) locating ears 56 and 58 on the permanent magnet assembly into corresponding slots 60 and 62 in the limbs 52 and 54 respectively of the frame 40 to hold the whole rigidly in place.

The frame 40 and plunger 16 must be dimensioned such as to permit transverse insertion of the internal assembly into the frame 40 and axial movement of the inserted assembly as described, and to take account of the required working gap 63 of the completed solenoid. Within a given frame size a range of plunger lengths can be accomodated to provide a range of solenoids with a corresponding range of working gap 63 for differing requirements.

Figure 4B:
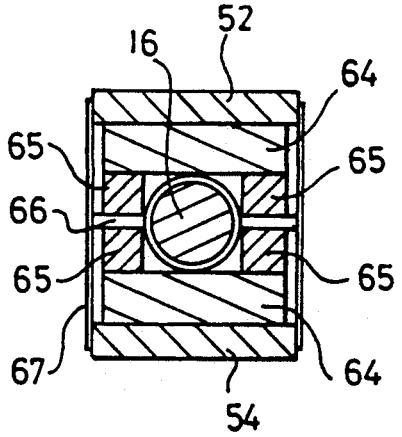
FIG. 4B is an end view of an improved magnet assembly of a solenoid.

FIG. 4B is end view of an improved arrangement of the permanent magnet assembly 50 of FIG. 4A. Bar magnets 64 mounted on the limbs 52 and 54 of the yoke extend above and below the plunger 16, and secured along their sides axially of the plunger are four pole pieces 65 made of mild steel and of approximately square sections. A plastic bridge 66 forms a spacer between opposed pairs of pole pieces, each bridge being secured to a thin wall 67 extending between the limbs 52 and 54.

The pole pieces in use redirect the flux, and since they approximate a segmented magnet they reduce the fringe losses and therefore make the arrangement more efficient. In tests it has been found that the magnet hold values are improved by approximately 40%.

The magnets are preferably made of a rare earth material, so that they can be made shorter in the direction parallel to the axis of the plunger. Thereby more space is provided for the winding 46.

Solenoids according to the invention may be employed as actuators for power relays and switches for switching industrial or domestic electrical loads. Two such devices are illustrated in relation to FIGS. 5 & 6, and to FIGS. 7 to 9.

Figure 5A:
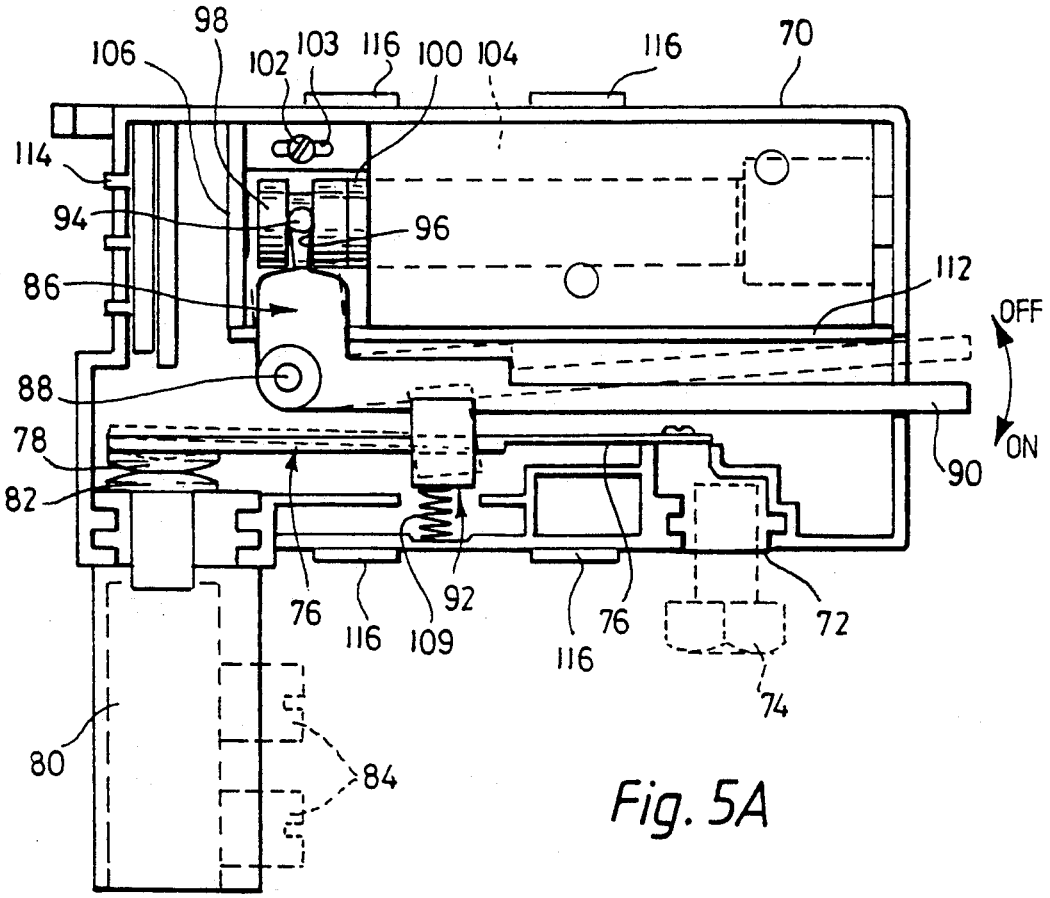
FIG. 5A and the scrap view of FIG. 5B together show a plan view of a switching device in accordance with the invention.
Figure 5B:
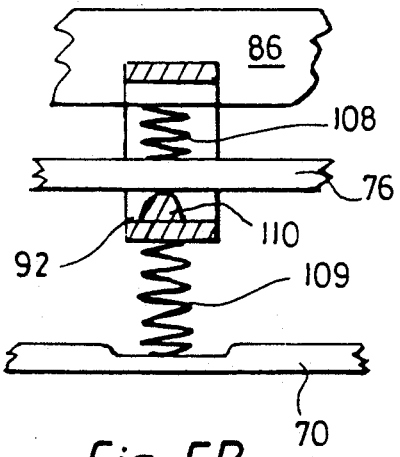
FIG. 5C is a scrap view of a modified extension lever.

Shown in FIG. 5A and 5B is a single-pole power relay or contactor switch configured for switching industrial or domestic electrical loads, typically at 100 A 250 V AC.

The relay is housed in a split moulded case 70 open initially for assembly and adjustment then closed to provide protection from shock and from the ingress of dust. The case is shown open in the drawing.

One power terminal 72 comprises a heavy metallic block with integral fins which engage positively in slots in case 70. Connection is made to external wiring by means of a bolt 74 engaging in a threaded hole in the terminal end face.

The moving part of the relay switch comprises a high conductivity blade 76 which is partly reduced in section towards its fixed end 76A to create flexibility and ease of movement. The fixed end of the blade is suitably attached by welding, screwing or rivetting to the inside face of terminal 72. A switching contact 78 attached to the free end of blade 76 is made of an alloy suitable for the magnitude of the switching currents likely to be encountered.

The second power terminal 80 is engaged positively at the other end of the moulded casing similarly to terminal 72, again using fins and slots. A second fixed contact 82 suitably attached to the inside face of terminal 80 is made of the same alloy as the moving blade contact. Both contacts are arranged so that optimum face-to-face alignment takes place. Connection to terminal 80 is made via the associated socket in which wiring is retained by grub screws 84.

The switching action is arranged to be such that contacts 78 and 82 make with adequate mating force so as to carry the high load currents and minimise heating effect due to those currents.

Actuation of the switch blade 76 is achieved via a non-conducting moulded link-arm-lever 86 pivoted as shown by a pin 88 in bearing bushes or within a bearing boss raised off the base of the case 70 to permit rotation. An extension 90 of the lever 86 extends through a slot in the case 70 to permit manual operation of the relay, for example for test or resetting purposes. The extension 90 also serves as a flag to indicate the current state of the relay.

Figure 5C:
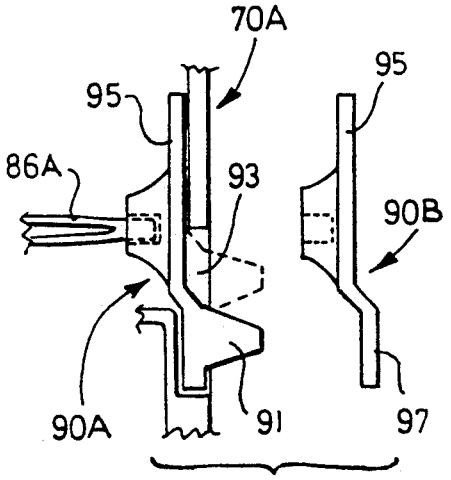

In a modification, shown in FIG. 5C, the extension instead comprises a separate part 90A connectable over the end of a slightly modified lever 86A. The extension part 90A includes a manually engageable protruberance 91 projecting through an aperture 93 in the casing 70A, so that its alternative positions are clearly visible (the upper position being shown chain dotted). The part 90A also includes a sliding portion 95 movable along the inside surface of the casing 70A.

Where the option of a manual operation of the relay/-switch is not required, the part 90A may readily be replaced by an alternative part 90B, shown to the right of FIG. 5C. The part 90B is similarly connectable over the lever 86A, but has a flat portion 97 in place of the protruberance 91 of the part 90A. Thus the part 90B serves only as a flag to indicate the two positions or states of the relay/switch.

In order to improve their visibility, the parts 90A and 90B are preferably made of a different colour from the casing 70A, for example the casing may be black while the parts 90A and 90B are orange.

Integral with the lever 86 is a U-shaped saddle member 92 through which the moving blade 76 passes and by means of which the blade is moved.

The actuating lever 86 is clipped pivotally by a U-shaped stirrup 94 to a slot 96 in the head 98 of plunger 100 of the magnet-assisted solenoid. The solenoid assembly is adjustably clamped into the base part of case 70 by at least two mounting screws such as shown at 102, each passing through a slot 103 in the assembly. The plunger 100 moves axially in the solenoid and that axial movement is translated to rotational movement of the lever 86.

With reference to the two flux-path schematics shown in FIGS. 2 and 3 and the deflection/force diagram of FIG. 6, the operation of the relay of FIGS. 5A and 5B is as follows.

The relay is set into the ON position when the appropriate coil of the winding 104 is pulsed with a suitable DC voltage and plunger 100 is drawn into the solenoid. This state is held indefinitely without any energisation of the winding until a pulse is applied to the other coil of the winding until a pulse is applied to the other coil of the winding 104 when the plunger 100 is withdrawn from the solenoid and engages the inner face of extension piece 106. This condition will again be maintained indefinitely without energisation of either winding. In the OFF condition the position of blade 76, lever 86 and lever extension 90 is as shown in dotted outline in the drawing.

The pick-up position of the switch-blade 76 is so determined as to provide positive drive and switching action with minimal contact bounce. In the ON direction the downward translated contact force is provided by a small compression spring 108 (or alternatively by a suitable leaf spring) trapped within the member 92 and engaging switch blade 76. In the OFF direction a lower radiussed face 110 of the member 92 picks up blade 76 and snaps open the contacts 78/82. This snap action minimises the effect of contact arcing due to the cessation of the load current through the contacts.

To assist speedy contact arc breaking when the switching contacts are opened, a further compression coil spring 109 is provided between member 92 and the adjacent inner face of case 70. The spring also improves the "feel" of the manual switching action.

Adjustment of the contact separation between contacts 78 and 82 (and hence also of the contact pressure when closed) is simply achieved in manufacture, or subsequently by simple adjustment of the solenoid along its principal axis by loosening the mounting screws 102 which pass through brackets in slots 103 parallel to the solenoid axis. This movement is transmitted to the moving contact of the switch via the pivotted lever, linked at its other end to the solenoid plunger.

In a proposed preferred arrangement, particularly suitable during manufacture, the adjustment is achieved by provisionally replacing the fixed contact 82 with a shorter contact, i.e. whose contact face is further from the movable contact 78. The solenoid is then adjusted until the contacts just touch when closed. When the original contact 82 is replaced there will then exist the correct contact pressure between the contacts.

The necessary electrical isolation between the low voltage DC winding, the metal parts of the solenoid and the 250 V AC on the switch blades and contacts is provided by a barrier wall 112 intergrally moulded into case 70. Connections to the winding coils are made via socket 114, located in a slot in case 70, terminated by flying leads or a flexible printed circuit. Clip ears 116 are provided upon case 70 for locating and clipping the case in an associated moulding cover (not shown) through which the main terminal connections may be made.

FIG. 7 shows diagramatically a single-pole power relay configured for switching industrial or domestic electrical loads typically at 250 V 25A AC. The relay again uses a solenoid actuator according to the invention for its operation.

The relay is housed in a split moulded case 120 shown open in the drawing.

The fixed switch part of the relay comprises a heavy metal fixed blade 122 with an integral terminal tabs 124 and 125 firmly fixed in position in slots in the wall of case 120. Contact 126 attached to blade 112 is of an alloy suitable for the currents to be switched.

The moving part of the switch comprises a high conductivity flexible blade 128 suitably bonded at its base to a heavier blade and tab terminal 130, also firmly fixed by slots in the case well. Contact 132 attached to blade 128 is also of an alloy suitable for the currents to be switched.

Switching action is such that contacts 126 and 132 make with adequate over-travel force so as to carry the load currents and miminise the resultant heating effect.

Figure 8:
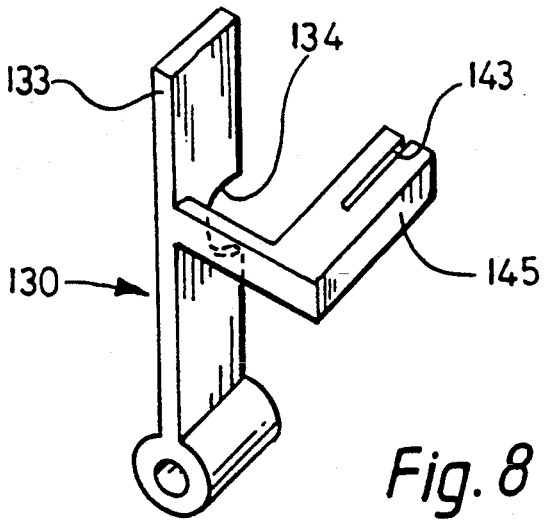
FIG. 8 is a perspective view of a lever used in the device of FIG. 7.

Actuation of the switch-blade 128 is achieved via non-conductive moulded link-arm-lever 130, shown separately in FIG. 8, pivotted upon pins 132 moulded into the two parts of case 120. An extension 133 of the lever 130 projects through a slot in case 120 to permit manual actuation of the relay and to provide a visual indication of the relay state.

Cut-out 134 on lever 130 engages the slot of the head 136 of plunger 138 of the permanent magnet assisted solenoid 140 which is retained in the base of the case 120 by integrally moulded clips 142. Slot 143 in bracket 145 upon lever 130 sits about switch blade 128 to transmit to it the axial motion of plunger 138.

Lever 130 may be stepped in the region of cut-out 134 to sit about the head of plunger as shown in FIG. 7.

The soft iron limbs 144 together with extension bracket 146 redirect the magnetic actuation flux through the end-face of plunger 138 over air gap 148 of sufficient width to enable reliable switching action of the relay. This arrangement gives maximum drive force at the extent of travel.

Two coils 150/152 form the winding of solenoid 140. Two permanent magnets 154 are mounted in a moulding 155 which sits adjacent the winding within the solenoid frame.

One of the coils 150/152 sets the relay to the ON position when pulsed with a suitable DC pulse. In the ON position the head 136 of plunger 138 is held in engagement with the inner face of extension bracket 146 and link-arm-lever 130 holds switch blade 128 with contact 132 against fixed contact 126. This state is maintained indefinitely without energisation of either coil, because of the flux paths established by the permanent magnets, until a re-set pulse is applied to the other of the two coils.

This will return the relay to its stable OFF state, again held indefinitely without energisation of either coil, with plunger 138 drawn into the solenoid and the lever 130 held in the position shown in FIG. 7 with contacts 138 and 126 separated.

A barrier wall 156, moulded into the case 120, provides the necessary electrical isolation between the low voltage DC drive coils 150/152, the metal parts of the solenoid 140 and the load switching components of the relay.

Connections to the drive coils are made via flying leads 158, connector 160 and pins 162, which may be soldered to a printed circuit board. The terminal tabs 124 and 125 are also provided with solder tags 164 to provide anchorage to a printed circuit board if required.

An optional second fixed switch blade 166 is shown which may be provided, together with a contact (not shown) facing contact 132, to enable the relay to perform a change-over function, enabling two electrical loads to be switched by the moving blade 128.

Figure 9:
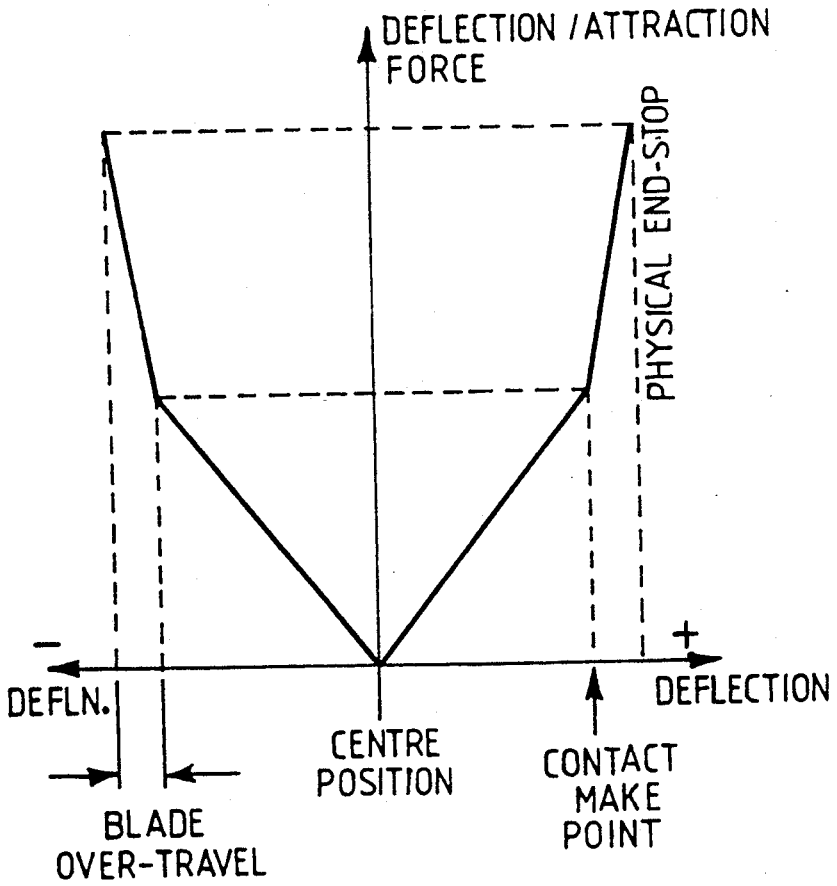
FIG. 9 shows a deflection/force diagram for the device of FIGS. 7 and 8.

FIG. 9 shows the deflection/force diagram for the relay described in relation to FIGS. 7 and 8.

Although the switching devices above described employ as actuator a bistable permanent magnet solenoid, such as is the subject of copending PCT Application No. PCT/GB91/00871, other forms of solenoid actuator in which the plunger is held at the end points of its travel by permanent magnet, electromagnetic or mechanical means, may also be employed.

We claim:

1. A switching device comprising a solenoid actuator, a lever made of electrically insulating material pivotally mounted for movement by the actuator, a flexible switch contact bearing element having a movable contact at one end for engagement with a fixed contact, connection means connecting the lever to the contact bearing element to move the contacts between open and closed states, and means adjustably mounting the solenoid actuator to enable contact separation between the fixed and movable contacts to be readily adjusted.

2. A switching device according to claim 1 in which the contact bearing element is in the form of a blade which is substantially parallel to the axis of the solenoid actuator, and the lever is cranked so that it has a first arm substantially aligned with the blade.

3. A switching device according to claim 2 further comprising an electrically insulating wall mounted between the solenoid actuator and the first arm of the lever.

4. A switching device according to claim 1 in which the connection means comprises a compression spring acting between the first arm and the contact bearing element.

5. A switching device according to claim 1 in which the connection means comprises a U-shaped member extending over the contact bearing element and engageable with the remote side thereof to open the movable contact.

6. A switching device according to claim 5 in which a second spring is disposed between a fixed part of the device and the U-shaped member to assist opening of the movable contact.

7. A switching device according to claim 1 in which the device is mounted in a casing and the lever is formed with an extension outside of the casing to enable the device to be manually operated.

8. A switching device according to claim 7 in which the extension of the lever is separable from the lever which moves as the solenoid actuator is operated, the end of the lever being visible through a window in the casing, whereby when the extension is removed there remains a means for indicating whether the switch is open or closed.

9. A switching device according to claim 1 in which the solenoid actuator is a bistable solenoid having an armature plunger with fixed permanent magnet means adjacent thereto, whereby the plunger is maintained in a stable position at each end of its movement.

10. A switching device comprising a solenoid actuator, a lever made of electrically insulating material pivotally mounted for movement by the actuator, a flexible switch contact bearing element having a movable contact at one end for engagement with a fixed contact, connection means connecting the lever to the contact bearing element to move the contacts between open and closed states, and the device being mounted in a casing and the lever being formed with an extension outside of the casing to enable the device to be manually operated, the extension of the lever being separable from the lever which moves as the solenoid actuator is operated, the end of the lever being visible through a window in the casing, whereby when the extension is removed there remains a means for indicating whether the switch is open or closed.

11. A switching device according to claim 10 in which the contact bearing element is in the form of a blade which is substantially parallel to the axis of the solenoid actuator, and the lever is cranked so that it has a first arm substantially aligned with the blade.

12. A switching device according to claim 11 further comprising an electrically insulating wall mounted between the solenoid actuator and the first arm of the lever.

13. A switching device according to claim 10 in which the connection means comprises a compression spring acting between the first arm and the contact bearing element.

14. A switching device according to claim 10 in which the connection means comprises a U-shaped member extending over the contact bearing element and engageable with the remote side thereof to open the movable contact.

15. A switching device according to claim 14 in which a second spring is disposed between a fixed part of the device and the U-shaped member to assist opening of the movable contact.

16. A switching device according to claim 10 in which the solenoid actuator is a bistable solenoid having an armature plunger with fixed permanent magnet means adjacent thereto, whereby the plunger is maintained in a stable position at each end of its movement.

17. In a method of manufacturing a switching device including a solenoid actuator, a lever made of electrically insulating material pivotally mounted for movement by the actuator, a flexible switch contact bearing element having a movable contact at one end for engagement with a fixed contact, and connection means connecting the lever to the contact bearing element to move the contact between open and closed state, the improvement comprising the steps of providing adjustment means for adjusting the position of the solenoid actuator at least along its direction of actuation, releasing the adjustment means, moving the actuator to provide the correct position for the movable contact, and securing the adjustment means.

18. A method according to claim 19 comprising the further steps of temporarily replacing the fixed contact by a thinner contact, setting the movable contact until in its closed state it just touches the movable contact, securing the adjustment means, and replacing the thinner contact with the original contact to provide contact pressure between the contacts.

* * * * *